US008264411B2

(12) United States Patent
Murayama et al.

(10) Patent No.: US 8,264,411 B2
(45) Date of Patent: Sep. 11, 2012

(54) ANTENNA STRUCTURE AND WIRELESS COMMUNICATION DEVICE HAVING THE SAME

(75) Inventors: Takuya Murayama, Ishikawa-gun (JP); Kunihiro Komaki, Yokohama (JP); Takashi Ishihara, Ishikawa-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 358 days.

(21) Appl. No.: 12/581,235

(22) Filed: Oct. 19, 2009

(65) Prior Publication Data

US 2010/0026588 A1 Feb. 4, 2010

Related U.S. Application Data

(63) Continuation of application No. PCT/JP2008/057015, filed on Apr. 9, 2008.

(30) Foreign Application Priority Data

May 2, 2007 (JP) ..... 2007-121817

(51) Int. Cl.

| | |
|---|---|
| ***H01Q 1/38*** | (2006.01) |
| ***H01Q 1/24*** | (2006.01) |
| ***H01Q 1/48*** | (2006.01) |

(52) U.S. Cl. ..... 343/700 MS; 343/702; 343/846

(58) Field of Classification Search ..... 343/700 MS, 343/846, 767, 895, 702
See application file for complete search history.

(56) References Cited

U.S. PATENT DOCUMENTS

| | | | | |
|---|---|---|---|---|
| 6,075,485 | A * | 6/2000 | Lilly et al. | 343/700 MS |
| 6,501,425 | B1 | 12/2002 | Nagumo et al. | |
| 6,686,406 | B2 | 2/2004 | Tomomatsu et al. | |
| 2004/0155819 | A1 * | 8/2004 | Martin et al. | 343/700 MS |
| 2005/0017902 | A1 | 1/2005 | Oyama et al. | |
| 2005/0206574 | A1 | 9/2005 | Okayama | |

(Continued)

FOREIGN PATENT DOCUMENTS

EP 1 217 688 A1 6/2002

(Continued)

OTHER PUBLICATIONS

Official Communication issued in International Patent Application No. PCT/JP2008/057015, mailed on Jun. 10, 2008.

(Continued)

*Primary Examiner* — Jacob Y Choi
*Assistant Examiner* — Hasan Islam
(74) *Attorney, Agent, or Firm* — Keating & Bennett, LLP

(57) ABSTRACT

An antenna element has a dielectric base, at least a portion of which is arranged in a non-ground region of a substrate. A feeding radiation electrode has an intermediate path that is connected to a feeding portion and that is arranged to extend in a perimeter direction of the dielectric base on a side surface of the dielectric base adjacent to the non-ground region and spaced away from a ground region. The feeding radiation electrode has an open end side path that is arranged to extend along a loop path from the termination of the intermediate path and an open end of the extended distal end is arranged parallel or substantially parallel to and spaced apart from the intermediate path. A dielectric material having a high dielectric constant, which increases the capacitance between the intermediate path and the open end, is located in a region including the spaced region between the intermediate path and parallel or substantially parallel open end.

12 Claims, 9 Drawing Sheets

U.S. PATENT DOCUMENTS

| | | | |
|---|---|---|---|
| 2006/0176220 | A1 | 8/2006 | Tamaoka |

FOREIGN PATENT DOCUMENTS

| | | | |
|---|---|---|---|
| EP | 1 221 735 | A1 | 7/2002 |
| EP | 1 376 759 | A2 | 1/2004 |
| EP | 1 091 915 | B1 | 9/2004 |
| JP | 11-122024 | A | 4/1999 |
| JP | 2002-111368 | A | 4/2002 |
| JP | 2002-158529 | A | 5/2002 |
| JP | 2003-078322 | A | 3/2003 |
| JP | 2003-158410 | A | 5/2003 |
| JP | 2004-193875 | A | 7/2004 |
| JP | 2004-312364 | A | 11/2004 |
| JP | 2005-130333 | A | 5/2005 |
| JP | 2006-203446 | A | 8/2006 |
| KR | 10-0632692 | B1 | 9/2006 |
| WO | 01/18909 | A1 | 3/2001 |
| WO | 2006/073034 | A1 | 7/2006 |
| WO | 2006/077714 | A1 | 7/2006 |
| WO | WO 2006077714 | A1 * | 7/2006 |
| WO | 2007/083921 | A1 | 7/2007 |

OTHER PUBLICATIONS

Official Communication issued in corresponding German Patent Application No. 11 2008 001 154.0, mailed on Aug. 18, 2011.

* cited by examiner

ANTENNA STRUCTURE AND WIRELESS COMMUNICATION DEVICE HAVING THE SAME

BACKGROUND OF THE INVENTION

1. Field of the Invention

The present invention relates to an antenna structure provided for a wireless communication device, such as a cellular phone, and a wireless communication device having the antenna structure.

2. Description of the Related Art

FIG. 9 is a schematic perspective view of an example of an antenna structure (for example, see Japanese Unexamined Patent Application Publication No. 2006-203446). The antenna structure 40 has an antenna element 41. The antenna element 41 is defined by a dielectric base 42 and a feeding radiation electrode 43. The feeding radiation electrode 43 is provided on the dielectric base 42 and operates as an antenna. The feeding radiation electrode 43 has a slit S. Due to the slit S, the feeding radiation electrode 43 has a long electrical length extending from a feeding portion Q, which defines one end of a current path of the feeding radiation electrode 43, to an open end K, which defines the other end, as compared to the case in which no slit S is provided. Thus, by elongating the electrical length, the size of the feeding radiation electrode 43 is reduced, while the feeding radiation electrode 43 may have an electrical length with which the feeding radiation electrode 43 resonates at a predetermined wireless communication frequency band.

The antenna element 41 is, for example, mounted in a non-ground region Zp of a circuit board 44 of a wireless communication device. The circuit board 44 has a ground region Zg in which a ground electrode 45 is provided and the non-ground region Zp in which no ground electrode 45 is provided. The antenna element 41 is mounted on the non-ground region Zp. When the antenna element 41 is mounted at a predetermined position in the non-ground region Zp, the feeding portion Q of the feeding radiation electrode 43 is electrically connected to a wireless communication circuit 47 through a feeding line 46 provided on the circuit board 44.

In the antenna structure 40, for example, when a wireless transmission signal is supplied from the wireless communication circuit 47 to the feeding radiation electrode 43, the feeding radiation electrode 43 resonates and then the wireless transmission signal is wirelessly transmitted. In addition, when a signal arrives and the feeding radiation electrode 43 resonates to receive the signal, the received signal is transferred from the feeding radiation electrode 43 to the wireless communication circuit 47.

Incidentally, in recent years, miniaturization has been required, particularly, for a wireless communication device, such as a portable mobile terminal with wireless communication function (for example, cellular phone). Because of this requirement, miniaturization is also required for the antenna structure. To miniaturize the antenna element 41, the feeding radiation electrode 43 also needs to be miniaturized. However, when the feeding radiation electrode 43 is miniaturized, the electrical length becomes insufficient and, therefore, the resonant frequency of the feeding radiation electrode 43 cannot be decreased to a desired frequency. As a result, the feeding radiation electrode 43 is not able to wirelessly communicate in a predetermined wireless communication frequency band. Thus, to miniaturize the feeding radiation electrode 43, it is necessary to take some measures to elongate the electrical length.

As an example of such measures, as shown in FIG. 9, the feeding radiation electrode 43 has a meandering shape, or other suitable shape, to elongate the physical length from the feeding portion Q to the open end K, thus elongating the electrical length. When these measures are used, the shape of the feeding radiation electrode 43 is complex and, in addition, the path width of the feeding radiation electrode 43 is relatively narrow. A narrow path width problematically causes an increase in conduction loss and, as a result, the efficiency of the antenna deteriorates. In addition, with a complex shape, a problem arises in that it is difficult to adjust the resonant frequency of the feeding radiation electrode 43.

In addition, with the configuration of the antenna structure 40 shown in FIG. 9, in addition to the problems related to miniaturization, the following problems also exist. That is, the antenna element 41 is mounted on the circuit board 44, such that the antenna element 41 is arranged adjacent to the ground electrode 45 that is required for the circuit board 44. Then, the electric field of the feeding radiation electrode 43 is attracted toward the ground electrode 45 to increase the Q value. For this reason, there is a problem in that it is difficult to provide a wide frequency band for wireless communication.

In addition, for example, a hand that is holding or operating a wireless communication device (for example, cellular phone) may be located near the feeding radiation electrode 43. The hand functions as a ground and, therefore, a stray capacitance is formed between the feeding radiation electrode 43 and the hand. Due to the stray capacitance, there is a problem in that the antenna characteristic fluctuates or degrades to reduce the reliability to wireless communication.

SUMMARY OF THE INVENTION

To overcome the problems described above, preferred embodiments of the present invention are provided.

An antenna structure according to a preferred embodiment of the present invention includes an antenna element including a feeding radiation electrode, which operates as an antenna, that is provided on a dielectric base, and a substrate including a ground region in which a ground electrode is provided and a non-ground region in which no ground electrode is provided, wherein the antenna element is supported by the substrate so that at least portion of the antenna element is arranged in the non-ground region, wherein the feeding radiation electrode includes an intermediate path that is connected to a feeding portion of the feeding radiation electrode for electrical conduction and that is arranged to extend in a perimeter direction on a side surface of the dielectric base adjacent to the non-ground region, and an open end side path that is arranged to extend along a loop path that extends from the termination of the intermediate path in a direction so as to separate from the intermediate path on a surface of the dielectric base and then return toward the intermediate path, wherein an open end of the extended distal end is parallel or substantially parallel to and spaced apart from the intermediate path, wherein the dielectric base includes a plurality of base portions including a base portion having a portion disposed in a spaced region between the parallel or substantially parallel open end and intermediate path of the feeding radiation electrode, and wherein the base portion having the portion disposed in the spaced region between the parallel or substantially parallel open end and intermediate path is made of a dielectric material having a dielectric constant greater than dielectric constants of the other base portions.

An antenna structure according to another preferred embodiment of the present invention includes an antenna element including a feeding radiation electrode, which operates as an antenna, that is provided on a dielectric base, and a substrate including a ground region in which a ground electrode is provided and a non-ground region in which no ground electrode is provided, wherein the antenna element is supported by the substrate so that at least portion of the antenna element is arranged in the non-ground region, wherein the feeding radiation electrode includes an intermediate path that is connected to a feeding portion of the feeding radiation electrode for electrical conduction and that is arranged to extend in a perimeter direction on a side surface of the dielectric base adjacent to the non-ground region, and an open end side path that is arranged to extend along a loop path that extends from the termination of the intermediate path in a direction so as to separate from the intermediate path on a surface of the dielectric base and then return toward the intermediate path, wherein an open end of the extended distal end is parallel or substantially parallel to and spaced apart from the intermediate path, and wherein a dielectric material having a dielectric constant greater than the dielectric base is disposed in the spaced region between the parallel or substantially parallel open end and intermediate path of the feeding radiation electrode.

A wireless communication device according to another preferred embodiment of the present invention includes an antenna according to a preferred embodiment of the present invention.

In various preferred embodiments of the present invention, the open end of the feeding radiation electrode is preferably arranged parallel or substantially parallel to and spaced apart from the intermediate path, and a capacitance is generated and present between the open end and the intermediate path. The open end is a portion having the strongest electric field within the feeding radiation electrode. Thus, by forming the capacitance between the open end and the intermediate path, it is possible to effectively increase the capacitance component of the feeding radiation electrode to thereby elongate the electrical length. By so doing, preferred embodiments of the present invention greatly decrease the resonant frequency of the feeding radiation electrode.

In addition, a preferred embodiment of the present invention preferably includes any one of the following configurations. That is, preferred embodiments of the present invention provide a configuration in which a dielectric base portion having a portion disposed in the spaced region between the parallel or substantially parallel open end and intermediate path is made of a dielectric material having a dielectric constant greater than the other dielectric base portion. In addition, another preferred embodiment of the present invention provides a configuration in which a dielectric material having a dielectric constant greater than the dielectric base is disposed in the spaced region. With these configurations, preferred embodiments of the present invention are able to further increase the capacitance between the open end and the intermediate path to elongate the electrical length and, therefore, it is possible to decrease the resonant frequency of the feeding radiation electrode. Thus, preferred embodiments of the present invention are able to overcome the problem that the electrical length is insufficient and, therefore, it is easy to miniaturize the feeding radiation electrode.

In preferred embodiments of the present invention, the feeding radiation electrode preferably has a plurality of resonant frequencies. Then, among these plurality of resonant frequencies, by utilizing a basic mode which is a resonant operation at a basic resonant frequency, which is the lowest frequency, and a higher mode which is a resonant operation at a higher resonant frequency that is greater than the basic resonant frequency, wireless communication may be performed at a plurality of frequencies with one feeding radiation electrode.

Between the higher resonant frequency and the basic resonant frequency, the higher resonant frequency is substantially an integral multiple of the basic resonant frequency. With the above relationship, as the basic resonant frequency is decreased, the higher resonant frequency is also decreased. In addition, the resonant frequency of the feeding radiation electrode is preferably adjusted by changing the inductance component of the feeding radiation electrode or changing the capacitance component, and the rate of change in the higher resonant frequency with respect to a change in inductance component of the feeding radiation electrode is greater than the rate of change in the basic resonant frequency.

Thus, for example, in order to eliminate an insufficient electrical length due to miniaturization, when the resonant frequency is adjusted by changing the inductance component of the feeding radiation electrode, the following problem arises. That is, when the basic resonant frequency is decreased to a desired frequency by increasing the inductance component of the feeding radiation electrode to elongate the electrical length, a problem of top loading occurs. The top loading problem means that the higher resonant frequency excessively decreases beyond the allowable range of variations in frequency.

In contrast, according to preferred embodiments of the present invention by increasing the capacitance between the open end and the intermediate path, the capacitance component of the feeding radiation electrode is increased and, therefore, it is possible to easily decrease the resonant frequency. That is, preferred embodiments of the present invention prevent the top loading problem by adjusting the capacitance component of the feeding radiation electrode to thereby adjust the resonant frequency.

In addition, with preferred embodiments of the present invention, it is easy to adjust the dielectric constant of the spaced region between the parallel or substantially parallel open end and intermediate path. Thus, it is easy to adjust the resonant frequency of the feeding radiation electrode by adjusting the capacitance between the open end and the intermediate path. Furthermore, preferred embodiments of the present invention are able to decrease the resonant frequency of the feeding radiation electrode by increasing the capacitance between the open end and the intermediate path. Thus, preferred embodiments of the present invention do not require the feeding radiation electrode to have a complex shape, such as a meandering shape, for example, as is required in the prior art. That is, preferred embodiments of the present invention do not require a reduction in the path width of the feeding radiation electrode. Thus, it is possible to prevent a conduction loss by preventing the concentration of electric current and, therefore, it is possible to improve the efficiency of the antenna.

Furthermore, in preferred embodiments of the present invention, the one end, at which the electric field is strongest within the feeding radiation electrode, is provided on the side surface of the dielectric base adjacent to the non-ground region spaced away from the ground region (or in a region at an end of the dielectric film adjacent to the non-ground region spaced away from the ground region). Moreover, preferred embodiments of the present invention form a capacitance between the open end and the intermediate path. Thus, preferred embodiments of the present invention are able to greatly reduce the electric field attracted to the ground electrode from the feeding radiation electrode. Thus, in preferred embodiments of the present invention, because the Q value is decreased to widen the frequency band, it is possible to improve the efficiency of the antenna.

Furthermore, preferred embodiments of the present invention have a configuration in which the open end, at which the electric field is strongest within the feeding radiation electrode, forms a capacitance with the intermediate path. Thus, for example, even when the hand of a person who operates the wireless communication device is located adjacent to the feeding radiation electrode, it is possible to prevent the stray capacitance between the feeding radiation electrode and the hand. By so doing, preferred embodiments of the present invention prevent variations and degradation of the antenna characteristic due to the hand of a person, and the like, and, therefore, it is possible to improve the reliability of wireless communication.

Furthermore, when the dielectric base is preferably made of resin, for example, when the feeding radiation electrode is defined by a conductor plate, the feeding radiation electrode may be integrally molded with the dielectric base by insert molding, for example. Thus, it is easy to manufacture the antenna element, and it is possible to thermally weld the feeding radiation electrode with the dielectric base or adhesively bond the feeding radiation electrode with the dielectric base, for example.

When the feeding radiation electrode is preferably formed by plating, the dielectric base made of resin needs to be configured so that a portion defining the feeding radiation electrode is made of a resin having good plating adhesion. Thus, the entire dielectric base may preferably be made of a resin having good plating adhesion, for example. However, a resin having good plating adhesion typically has a low dielectric constant and, therefore, it is impossible to satisfactorily increase the capacitance between the open end of the feeding radiation electrode and the intermediate path.

Thus, in a preferred embodiment of the present invention in which the feeding radiation electrode is formed by plating, the dielectric base surface portion on which the feeding radiation electrode is formed, is preferably made of a resin having a low dielectric constant (for example, relative dielectric constant less than about 6) and having good plating adhesion, and the majority of the remaining dielectric base portion is preferably made of a resin having a high dielectric constant (for example, relative dielectric constant greater than or equal to about 6) and having poor plating adhesion. In this manner, by configuring the dielectric base to have a combination of the resin having good plating adhesion and the resin having poor plating adhesion, it is possible to obtain a configuration in which a dielectric material having a high dielectric constant that increases the capacitance between the open end and the intermediate path is provided in the spaced region between the open end and the intermediate path.

In addition, in another preferred embodiment of the present invention, the dielectric base surface portion, on which the feeding radiation electrode is disposed, is preferably made of a resin having a low dielectric constant and good plating adhesion, the spaced region between the open end and the intermediate path is preferably made of a resin having a dielectric constant, which is greater than the resin having the low dielectric constant and good plating adhesion, and poor plating adhesion, and the majority of the remaining dielectric base portion is preferably made of a resin having a low dielectric constant and poor plating adhesion. A dielectric material having a high dielectric constant, which increases the capacitance between the open end and the intermediate path, is preferably provided in the spaced region between the open end and the intermediate path. With this configuration, it is possible to form the feeding radiation electrode on the dielectric base made of resin by plating, for example. Furthermore, with this configuration, it is possible to arrange a dielectric material that increases the capacitance between the open end and the intermediate path in the spaced region between the open end of the feeding radiation electrode and the intermediate path. Furthermore, with this configuration, because the other portion is made of a resin having a low dielectric constant, it is possible to reduce the electric field caught by a ground.

Furthermore, when the non-feeding radiation electrode is provided on the dielectric base in addition to the feeding radiation electrode, it is possible to widen the frequency band of wireless communication using multiple resonations of the feeding radiation electrode and non-feeding radiation electrode and, therefore, it is possible to improve the antenna characteristic.

In addition, with a configuration in which a dielectric material having a dielectric constant, by which the electromagnetic coupling state between the feeding radiation electrode and the non-feeding radiation electrode is adjusted, is provided in the spaced region between the feeding radiation electrode and the non-feeding radiation electrode in the dielectric base, the following advantages are obtained. That is, with the above-described configuration, it is possible to easily adjust the electromagnetic coupling state between the feeding radiation electrode and the non-feeding radiation electrode to thereby make it possible to easily adjust the input impedance of the antenna element. Thus, it is easy to match the impedance of the antenna element with the impedance of the wireless communication circuit side that is electrically connected to the antenna element and, therefore, it is easy to improve the efficiency of the antenna. Therefore, preferred embodiments of the present invention having the above configuration obtain further improved antenna characteristics.

Furthermore, preferred embodiments of the present invention provide a configuration in which the antenna element is fixedly supported on the inner wall surface of the housing in which the substrate is accommodated and arranged instead of being fixed to the substrate, such that it is possible to increase the area of the substrate for mounting components by not arranging the antenna element on the substrate. In addition, because the housing easily ensures an installation space for the antenna element as compared to the substrate, it is possible to decrease the restrictions on the size of the antenna element. Furthermore, with the configuration that the feeding radiation electrode is provided on the dielectric film, it is possible to reduce the thickness of the antenna element.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Hereinafter, preferred embodiments according to the present invention will be described with reference to the accompanying drawings.

Figure 1C:
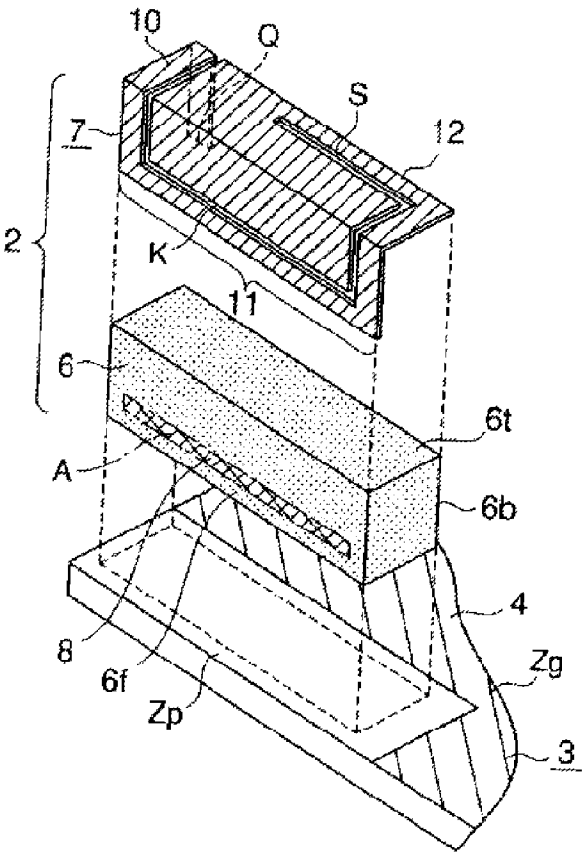
FIG. 1C is an exploded perspective view that illustrates the antenna structure according to the first preferred embodiment of the present invention.
Figure 1B:
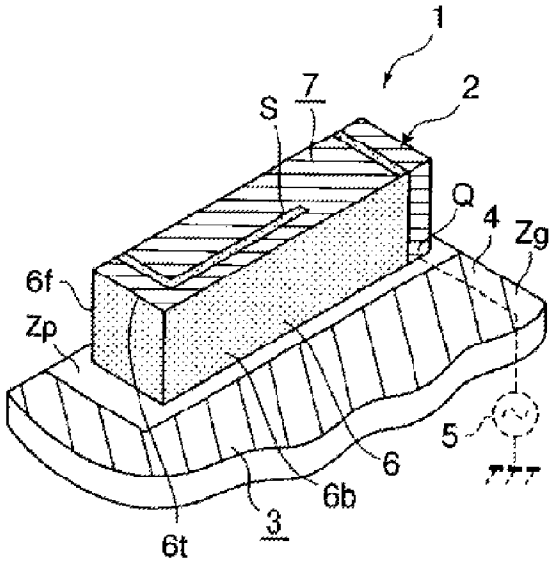
FIG. 1B is a perspective view that illustrates the antenna structure according to the first preferred embodiment of the present invention as viewed from the rear side in FIG. 1A.
Figure 1A:
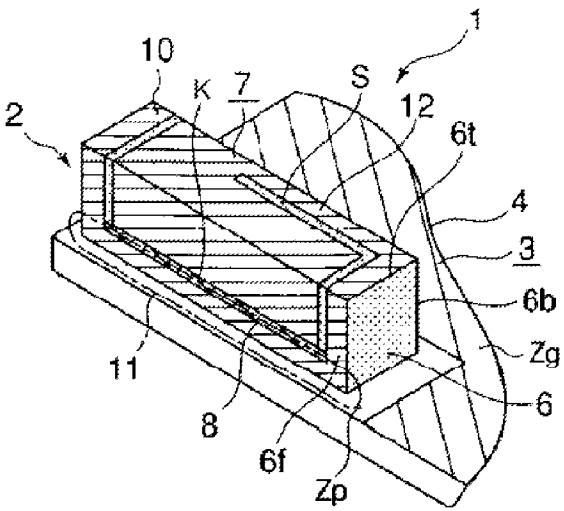
FIG. 1A is a perspective view that illustrates an antenna structure according to a first preferred embodiment of the present invention.

FIG. 1A shows a schematic perspective view of an antenna structure according to a first preferred embodiment. FIG. 1B shows a schematic perspective view of the antenna structure as viewed from the rear side of FIG. 1A. FIG. 1C is a schematic exploded view of the antenna structure of FIG. 1A. The antenna structure 1 of the first preferred embodiment includes an antenna element 2 and a substrate 3. The substrate 3 is preferably a circuit board of a wireless communication device, such as a cellular phone, for example. The substrate 3 includes a ground region Zg in which a ground electrode 4 is provided and a non-ground region Zp in which no ground electrode 4 is provided. In the first preferred embodiment, the non-ground region Zp is disposed at one end of the substrate 3. In addition, a wireless communication circuit (high-frequency circuit) 5 is provided on the substrate 3 (see FIG. 1B).

The antenna element 2 is preferably mounted (surface mounted) in the non-ground region Zp of the substrate 3. The antenna element 2 preferably includes a dielectric base 6 and a feeding radiation electrode 7. The dielectric base 6 preferably has a rectangular parallelepiped shape, for example. A dielectric material 8 having a high dielectric constant is provided at a surface portion of a region A shown in FIG. 1*c* on the dielectric base 6. In other words, in the first preferred embodiment, the dielectric base 6 preferably includes a base portion that defines the surface portion of the region A and a base portion other than the base portion. The region A is arranged in accordance with a specific portion of the feeding radiation electrode 7, and the specific portion will be described later.

In the first preferred embodiment, the dielectric material that defines the dielectric base 6 is preferably a resin having a relative dielectric constant less than about 6, for example. An example of the dielectric material is an LCP (liquid crystal polyester resin) or SPS (syndiotactic polystyrene resin) preferably having a relative dielectric constant less than about 6, for example. In addition, the dielectric material 8 having a high dielectric constant, provided on the surface portion of the region A of the dielectric base 6, is preferably a composite resin having a relative dielectric constant greater than or equal to about 6, for example. An example of the dielectric material having a high dielectric constant is an LCP or an SPS having a relative dielectric constant greater than or equal to about 6, mixed with a ceramic powder. The dielectric material 8 having a high dielectric constant is preferably embedded in the surface portion of the dielectric base 6. The thickness of the dielectric material 8 having a high dielectric constant is, for example, about 1 mm, and is preferably thinner than the thickness of the dielectric base 6.

The feeding radiation electrode 7 is defined by a conductor plate. The feeding radiation electrode 7 is integrally bonded on the surface of the dielectric base 6 preferably using an insert molding technique, thermal welding method, adhesive bonding method, or other suitable method. The feeding radiation electrode 7 has a portion disposed on a front surface 6*f* of the dielectric base 6, a portion disposed on a top surface 6*t* of the dielectric base 6, and a portion extending from the portion disposed on the top surface 6*t*, to a rear surface 6*b*. An extended distal end portion of the feeding radiation electrode 7, extended to the rear surface 6*b*, defines a feeding portion Q, and the feeding portion Q is electrically connected to the wireless communication circuit 5. The feeding radiation electrode 7 preferably has a slit S to regulate a current path. Based on the current path, the feeding radiation electrode 7 is divided into a feeding portion side path 10, an intermediate path 11 and an open end side path 12.

The feeding portion side path 10 is a feeding radiation electrode portion that extends from the feeding portion Q through the rear surface 6*b* and top surface 6*t* of the dielectric base 6 to the front surface 6*f*. Note that the front surface 6*f* is a side surface on the side adjacent to the non-ground region Zp and away from the ground region Zg. The intermediate path 11 is a feeding radiation electrode portion that extends from the termination of the feeding portion side path 10 on the front surface 6*f* of the dielectric base 6 in a perimeter direction (in other words, in a direction along the lower side of the front surface 6*f*). The open end side path 12 is a feeding radiation electrode portion that extends along a loop path that extends from the termination of the intermediate path 11 in a direction to separate from the intermediate path 11 on the surface of the dielectric base 6 and then returns toward the intermediate path 11. The extended distal end defines an open end K of the feeding radiation electrode 7, and the open end K is parallel or substantially parallel to and spaced apart from the intermediate path 11.

The above-described region A of the dielectric base 6 is a spaced region between the parallel or substantially parallel open end K and intermediate path 11 of the feeding radiation electrode 7. As described above, the region A is preferably made of the dielectric material having a dielectric constant greater than the dielectric base portion other than the region A. Thus, the first preferred embodiment is capable of increasing the capacitance formed between the open end K and the intermediate path 11 as compared to a configuration in which the region A has the same dielectric constant as that of the other dielectric base portion.

Figure 2:
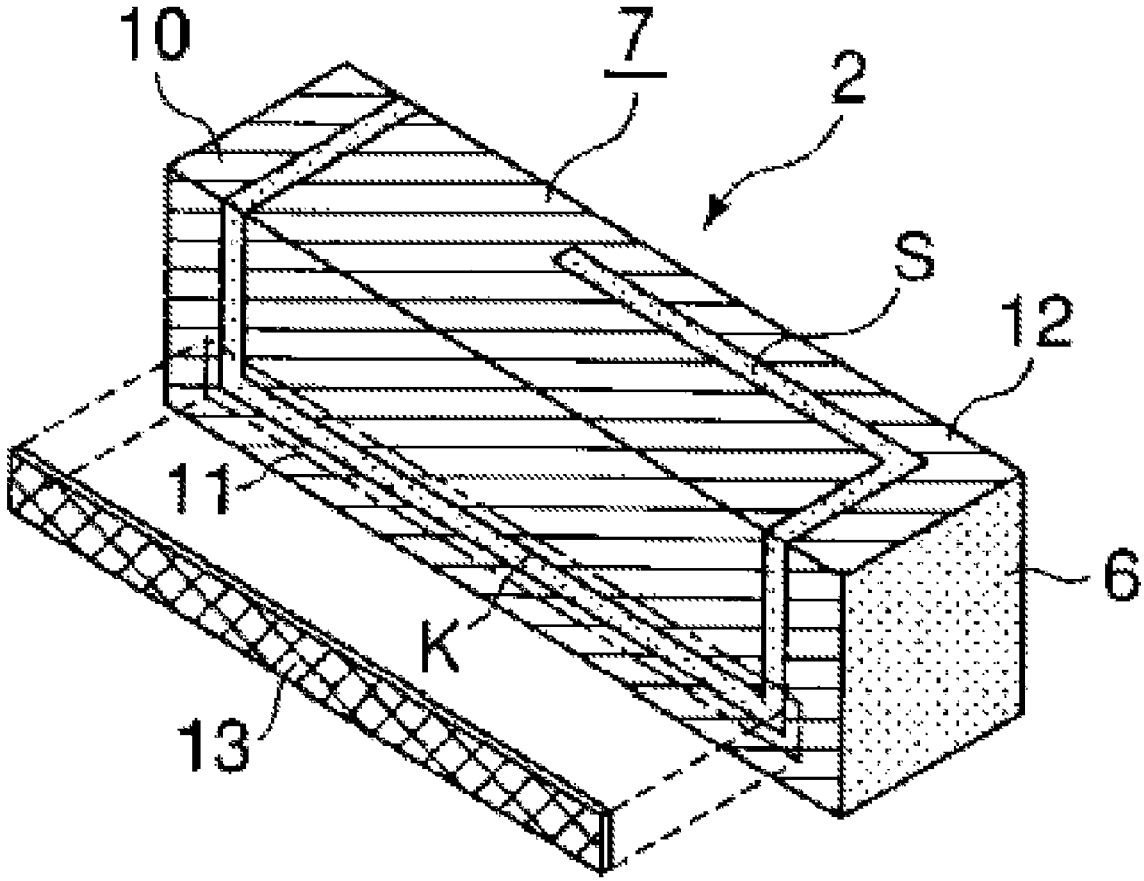
FIG. 2 is a view that illustrates an alternative example of the antenna structure according to the first preferred embodiment of the present invention.

Note that in the first preferred embodiment, the dielectric material having a high dielectric constant, provided in the spaced region between the parallel or substantially parallel open end K and intermediate path 11 of the feeding radiation electrode 7, is embedded in the surface portion of the dielectric base 6 to define a portion of the dielectric base 6 (a portion that defines the dielectric base 6). Instead of providing the portion of the dielectric base 6, for example, the dielectric material having a high dielectric constant may be configured as follows. That is, the dielectric material having a high dielectric constant may be a sheet-like member (high dielectric constant sheet) 13 as shown in FIG. 2. The high dielectric constant sheet 13 is preferably bonded by, for example, an adhesive agent, to the surface of the spaced region between the parallel or substantially parallel open end K and intermediate path 11 of the feeding radiation electrode 7. In this case, the high dielectric constant sheet 13 is capable of increasing the capacitance between the open end K of the feeding radiation electrode 7 and the intermediate path 11.

In addition, in the first preferred embodiment, the feeding radiation electrode 7 is preferably made of a conductor plate. Instead, the feeding radiation electrode 7 may be, for example, made of a conductor film on a film made of resin to define a film antenna, and the film antenna may be adhesively bonded to the dielectric base 6.

Hereinafter, a second preferred embodiment of the present invention will be described. Note that in the description of the second preferred embodiment, like reference numerals denote like components to those of the first preferred embodiment, and repetitive description of the same components is omitted.

Figure 3A:
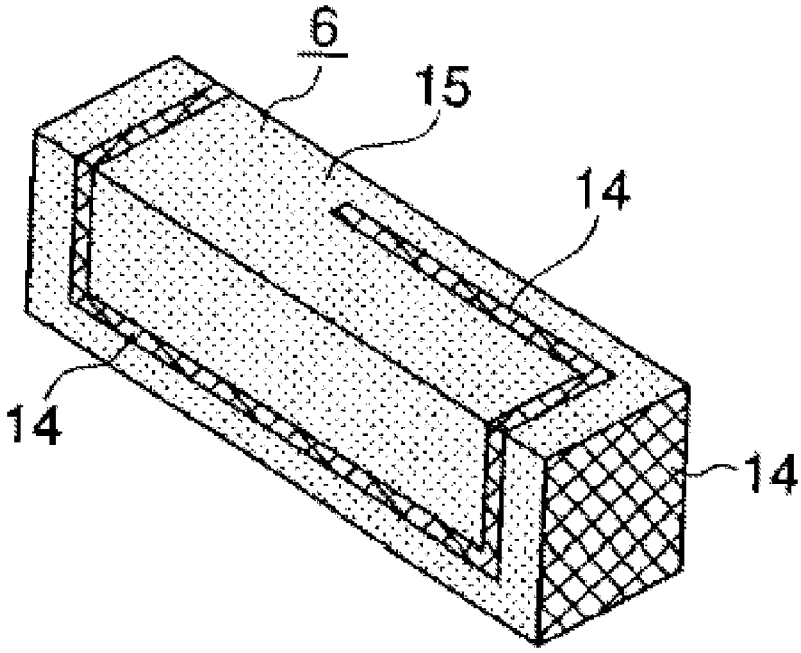
FIG. 3A is a perspective view that illustrates a preferred embodiment of a dielectric base that defines an antenna structure according to a second preferred embodiment of the present invention as viewed from the front side.
Figure 3B:
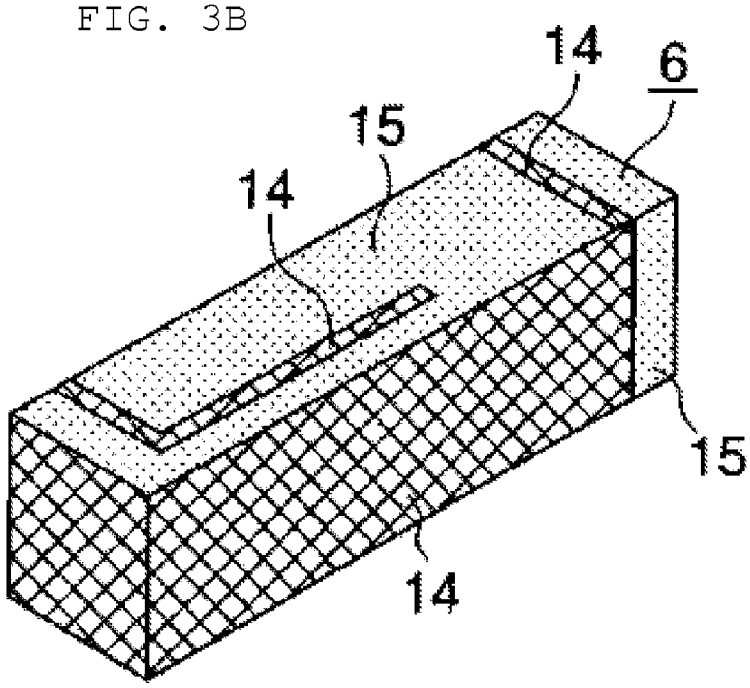
FIG. 3B is a perspective view that illustrates a preferred embodiment of a dielectric base that defines the antenna structure according to the second preferred embodiment of the present invention as viewed from the rear side.

In the second preferred embodiment, the feeding radiation electrode 7 is preferably formed by plating, for example. FIG. 3A schematically shows the dielectric base 6 in the second preferred embodiment as viewed from the front side. FIG. 3B schematically shows the dielectric base 6 of FIG. 3A as viewed from the rear side. As shown in FIGS. 3A and 3B, the dielectric base 6 preferably includes a base portion made of a resin 14 having a high dielectric constant and poor plating adhesion and a base portion made of a resin 15 having a low dielectric constant and good plating adhesion. The resin 15 having a low dielectric constant and good plating adhesion defines a surface portion of a feeding radiation electrode forming region. The resin 14 having a high dielectric constant and poor plating adhesion preferably defines the majority of the dielectric base portion other than the base portion made of the resin 15. The resin 14 having a high dielectric constant and poor plating adhesion is preferably a dielectric material having, for example, a relative dielectric constant greater than or equal to about 6 and that is poorly adhesive to a plated conductor film. The resin having poor plating adhesion may be, for example, polyester, polyphenylene sulfide, polyether ether ketone, polyether imide, polysulfone, polyether sulfone, SPS, or other suitable resin. By adding the above resin with, for example, ceramic powder, or other suitable resin, for increasing the dielectric constant, it is possible to increase the relative dielectric constant to, for example, about 6 or greater. In addition, the resin 15 having a low dielectric constant and good plating adhesion is preferably a dielectric material having, for example, a relative dielectric constant less than about 6 and that has good adhesion to a plated conductor film. The resin having good plating adhesion preferably may be, for example, a resin that is obtained by mixing the above described resin having poor plating adhesion with an electroless plating catalyst so as to have a property of good plating adhesion.

Because the dielectric base 6 is configured as described above, the second preferred embodiment has the following features. That is, when the dielectric base 6 is immersed in a plating liquid, a plated conductor film is provided only on the surface of a portion of the dielectric base 6, at which the resin 15 having good plating adhesion is provided, to thereby form the feeding radiation electrode 7. Here, because the region in which the slit S of the feeding radiation electrode 7 is provided is made of the resin 14 having poor plating adhesion, no conductor film is formed and, as a result, the slit S is formed. Then, the resin 14 having poor plating adhesion is a dielectric material having a high dielectric constant, so the following configuration similar to that of the first preferred embodiment is formed in the second preferred embodiment. That is, the dielectric material having a dielectric constant greater than the resin 14 having good plating adhesion, located at the dielectric base portion at which the open end K and the intermediate path 11 are provided, is arranged in the spaced region between the parallel or substantially parallel open end K and intermediate path 11 of the feeding radiation electrode 7.

The configuration other than the above in the antenna structure 1 of the second preferred embodiment is similar to that of the first preferred embodiment.

Hereinafter, a third preferred embodiment of the present invention will be described. Note that in the description of the third preferred embodiment, like reference numerals denote like components to those of the first and second preferred embodiments, and repetitive description of the same components is omitted.

Figure 4A:
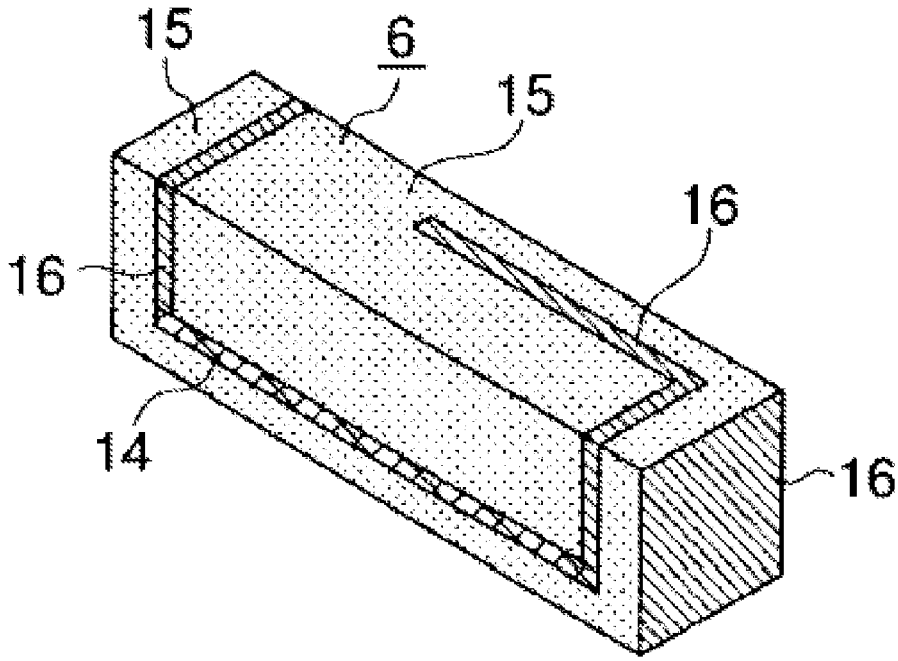
FIG. 4A is a perspective view that illustrates a preferred embodiment of a dielectric base that defines an antenna structure according to a third preferred embodiment of the present invention as viewed from the front side.
Figure 4B:
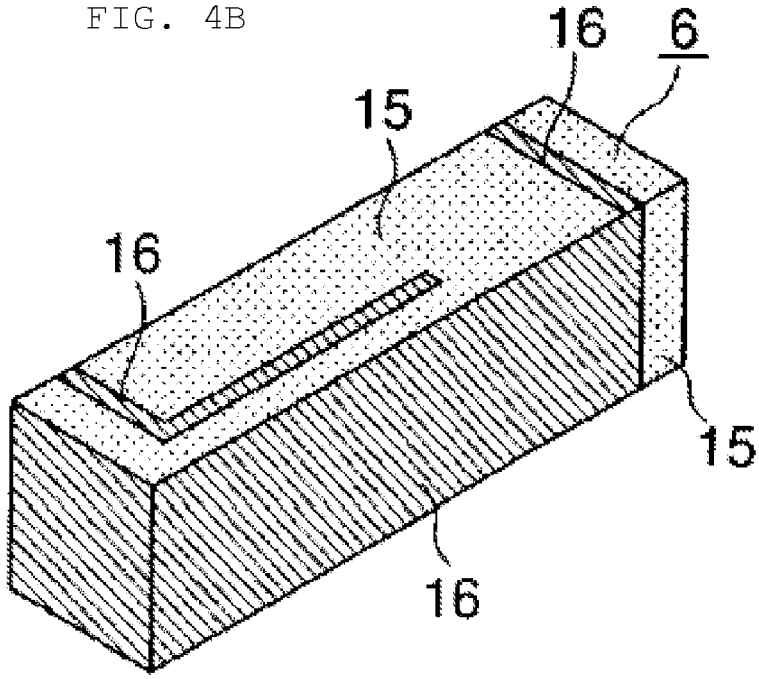
FIG. 4B is a perspective view that illustrates a preferred embodiment of the dielectric base that defines the antenna structure according to the third preferred embodiment of the present invention as viewed from the rear side.

In the third preferred embodiment, the feeding radiation electrode 7 is formed by plating, for example. In addition, FIG. 4A schematically shows a state of the dielectric base 6 in the third preferred embodiment as viewed from the front side. FIG. 4B schematically shows a state of the dielectric base 6 of FIG. 4A as viewed from the rear side. As shown in FIGS. 4A and 4B, the dielectric base 6 includes a base portion made of a resin 14 having a high dielectric constant and poor plating adhesion, a base portion made of a resin 15 having a low dielectric constant and good plating adhesion, and a base portion made of a resin 16 having a low dielectric constant and poor plating adhesion. Note that, the resin having a high dielectric constant is preferably, for example, a resin having a relative dielectric constant greater than or equal to about 6, and the resin having a low dielectric constant is preferably, for example, a resin having a relative dielectric constant less than about 6. The resin 14 having a high dielectric constant and poor plating adhesion preferably defines a surface portion of a spaced region between the parallel or substantially parallel open end K and intermediate path 11 of the feeding radiation electrode 7. The resin 15 having a low dielectric constant and good plating adhesion preferably defines a surface portion of a feeding radiation electrode forming region. The resin 16 having a low dielectric constant and poor plating adhesion preferably defines the majority of the dielectric base portion other than those portions described above.

In the third preferred embodiment, the resin provided at the surface portion of the feeding radiation electrode forming region of the dielectric base 6 is a resin having good plating adhesion. For this reason, the third preferred embodiment, as well as the second preferred embodiment, is capable of easily forming the feeding radiation electrode 7 in the feeding radiation electrode forming region of the dielectric base 6 by plating, for example. Note that in the third preferred embodiment, the resin 16 having poor plating adhesion, which primarily defines the dielectric base 6, is preferably a dielectric material having a low dielectric constant. Therefore, in the third preferred embodiment, if the resin 15 having good plating adhesion is provided only at the surface portion of the feeding radiation electrode forming region in the resin 16 having poor plating adhesion, the following problem occurs. That is, the dielectric material provided in the spaced region between the parallel or substantially parallel open end K and intermediate path 11 of the feeding radiation electrode 7 is the resin 16 having a low dielectric constant and poor plating adhesion, which is the same as that of the other regions in which the slit S is provided. Then, in order to increase the dielectric constant of the spaced region between the parallel or substantially parallel open end K and intermediate path 11 of the feeding radiation electrode 7, in the third preferred embodiment, the surface portion of the dielectric base is made of the resin 14 having a high dielectric constant and poor plating adhesion as described above. Thus, the dielectric constant of the spaced region between the parallel or substantially parallel open end K and intermediate path 11 increases to thereby make it possible to increase the capacitance.

The configuration other than the above in the antenna structure 1 of the third preferred embodiment is similar to that of the first or second preferred embodiment.

Hereinafter, a fourth preferred embodiment of the present invention will be described. Note that in the description of the fourth preferred embodiment, like reference numerals denote like components to those of the first to third preferred embodiments, and repetitive description of the same components is omitted.

Figure 5A:
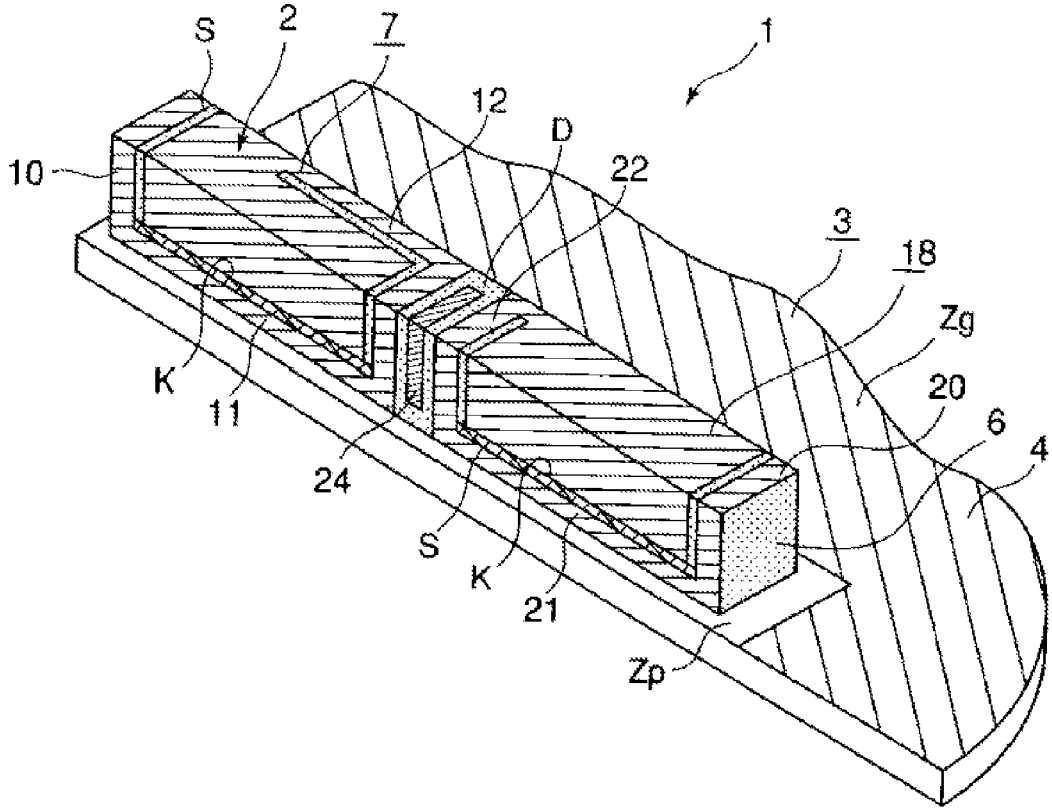
FIG. 5A is a perspective view of an antenna structure according to a fourth preferred embodiment of the present invention as viewed from the front side.
Figure 5B:
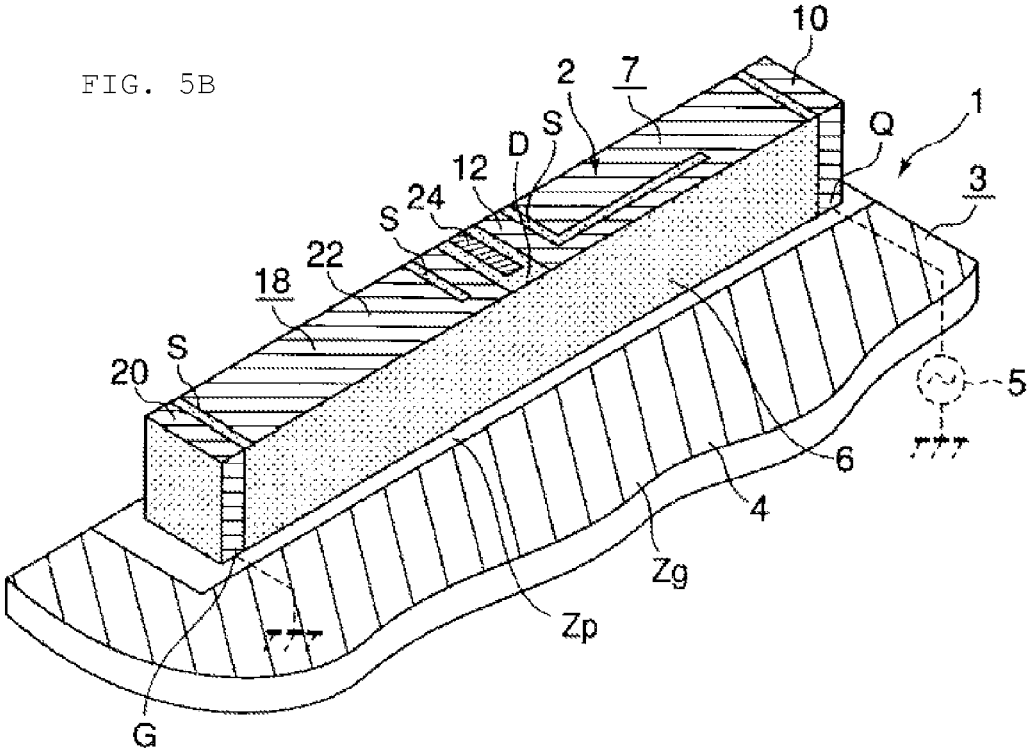
FIG. 5B is a perspective view of the antenna structure according to the fourth preferred embodiment of the present invention as viewed from the rear side.

FIG. 5A shows a schematic perspective view of an antenna structure according to the fourth preferred embodiment. FIG. 5B shows a schematic perspective view of the antenna structure as viewed from the rear side of FIG. 5A. The antenna structure 1 of the fourth preferred embodiment includes a non-feeding radiation electrode 18 on the dielectric base 6 of the antenna element 2 in addition to the configurations of the first to third preferred embodiments. The non-feeding radiation electrode 18 is preferably arranged adjacent to the feeding radiation electrode 7 at an interval D, and is preferably electromagnetically coupled to the feeding radiation electrode 7 to generate multiple resonances. The non-feeding radiation electrode 18, as well as the feeding radiation electrode 7, is preferably defined by a conductor plate, a conductor film that defines a film antenna, or a plated conductor film. In the fourth preferred embodiment, the non-feeding radiation electrode 18 preferably has a slit S, and a current path of the non-feeding radiation electrode 18 has a loop shape. In addition, one end of the non-feeding radiation electrode 18 defines a ground end G, and the other end defines an open end K. The non-feeding radiation electrode 18 has a ground end side path 20, an intermediate path 21, and an open end side path 22.

The ground end side path 20 is preferably a non-feeding radiation electrode portion that is arranged to extend from the ground end G through the top surface 6*t* of the dielectric base 6 toward the side surface (front surface) 6*f* of the dielectric base 6 adjacent to the non-ground region Zp and away from the ground region Zg. The intermediate path 21 is preferably a non-feeding radiation electrode portion that is arranged to extend from the termination of the ground end side path 20 on the front surface 6*f* of the dielectric base 6 in a perimeter direction of the dielectric base 6. The open end side path 22 is preferably a non-feeding radiation electrode portion that is arranged to extend along a loop path that extends from the termination of the intermediate path 21 in a direction to separate from the intermediate path 21 on the front surface 6*f* and top surface 6*t* of the dielectric base 6 and then returns toward the intermediate path 21. The extended distal end of the open end side path 22 defines an open end K, and the open end K is preferably parallel or substantially parallel to and spaced apart from the intermediate path 21.

The dielectric base 6 of the fourth preferred embodiment may have any one of the configurations of the dielectric bases 6 described above in the first to third preferred embodiments. For example, when the feeding radiation electrode 7 is made of a conductor plate, the dielectric base 6 preferably has a configuration similar to the first preferred embodiment. When the feeding radiation electrode 7 is formed by plating, the dielectric base 6 preferably has a configuration similar to the second or third preferred embodiment. In the dielectric base 6 of the fourth preferred embodiment, as described in the first to third preferred embodiments, the dielectric material (not shown in FIGS. 5A and 5B but shown as a dielectric material 8 in FIG. 1A, a high dielectric constant sheet 13 in FIG. 2, and a resin 14 in FIGS. 3A and 4A) having a high dielectric constant is provided in the spaced region between the parallel open end K and intermediate path 11 of the feeding radiation electrode 7. In addition, when further improved antenna characteristics are required, in the dielectric base 6, a dielectric material having a high dielectric constant is provided in the spaced region between the parallel or substantially parallel open end K and intermediate path 21 of the non-feeding radiation electrode 18. The dielectric material having a high dielectric constant provided in the spaced region between the parallel or substantially parallel open end K and intermediate path 21 may be the same as or may be different from the dielectric material having a high dielectric constant formed in the spaced region between the parallel or substantially parallel open end K and intermediate path 11 of the feeding radiation electrode 7.

Furthermore, in the dielectric base 6, a dielectric material 24 is preferably provided in a spaced region D between the feeding radiation electrode 7 and the non-feeding radiation electrode 18. The dielectric material 24 preferably has a dielectric constant by which the electromagnetic coupling state between the feeding radiation electrode 7 and the non-feeding radiation electrode 18 is adjusted to a predetermined state. As the electromagnetic coupling state between the feeding radiation electrode 7 and the non-feeding radiation electrode 18 is changed, the input impedance of the feeding radiation electrode 7 varies. Thus, the dielectric constant between the feeding radiation electrode 7 and the non-feeding radiation electrode 18 is set so that the electromagnetic coupling state between the feeding radiation electrode 7 and the non-feeding radiation electrode 18 matches the impedance of the antenna element 2 (feeding radiation electrode 7) with the impedance of the wireless communication circuit 5. In accordance with this setting, the dielectric material 24 is determined. The dielectric material 24 may have a dielectric constant greater than the dielectric constant of the dielectric base 6 or may have a dielectric constant less than the dielectric constant of the dielectric base 6.

Hereinafter, a fifth preferred embodiment of the present invention will be described. Note that in the description of the fifth preferred embodiment, like reference numerals denote like components to those of the first to fourth preferred embodiments, and repetitive description of the same components is omitted.

Figure 6A:
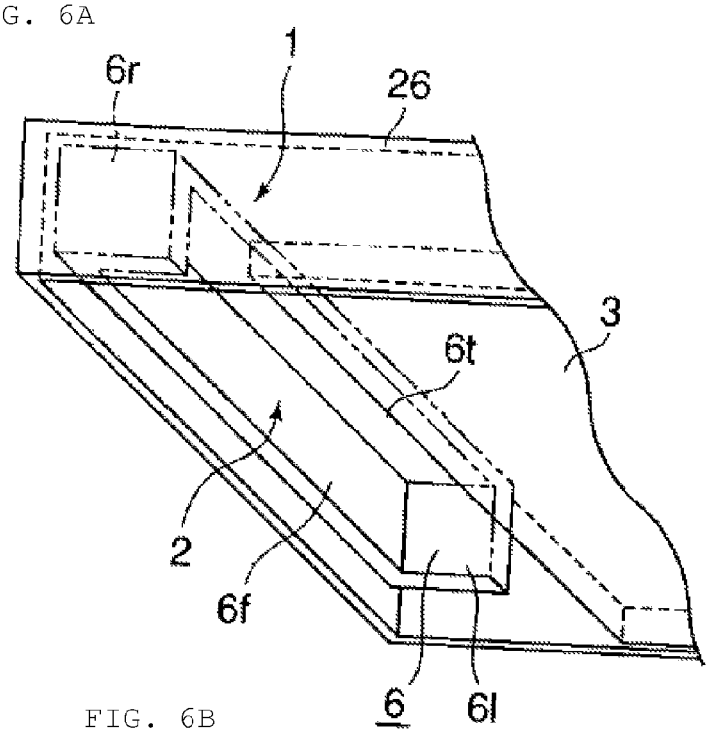
FIG. 6A is a view of an antenna structure as viewed from the lower side for illustrating a fifth preferred embodiment of the present invention.

FIG. 6A schematically shows the antenna structure 1 according to the fifth preferred embodiment of the present invention as viewed from the lower side. In the fifth preferred embodiment, the antenna element 2 is fixedly supported on an inner wall surface of a housing 26 in which the substrate 3 is accommodated and arranged by, for example, an antenna support member (not shown) instead of being fixedly supported by the substrate 3. In the fifth preferred embodiment, the antenna element 2 is preferably arranged at a portion spaced apart from a region in which the substrate 3 is arranged. In addition, the housing 26 is preferably made of an insulating material, such as resin, for example, and the entire housing is preferably a non-ground region. Thus, the entire antenna element 2 is arranged in the non-ground region.

Figure 6B:
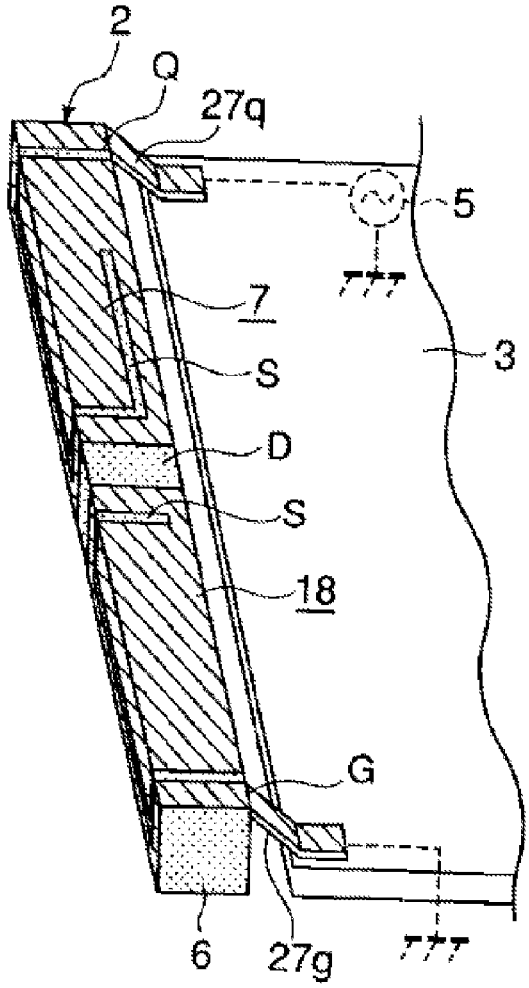
FIG. 6B is a view that shows an example of a configuration in which an antenna element is connected to a substrate according to the fifth preferred embodiment of the present invention.

FIG. 6B schematically shows one preferred embodiment of a structure in which the antenna element 2 is electrically connected to the substrate 3. In the example shown in FIG. 6A, connecting elastic conductor pieces 27*q* and 27*g* are electrically connected respectively to the feeding portion Q of the feeding radiation electrode 7 of the antenna element 2 and the ground end G of the non-feeding radiation electrode 18 of the antenna element 2. As the elastic conductor pieces 27*q* and 27*g* respectively press and contact the surface of the substrate 3 by elastic force, the elastic conductor piece 27*q* is electrically connected to the wireless communication circuit 5 of the substrate 3, and the elastic conductor piece 27*g* is grounded to the ground electrode 4 of the substrate 3.

Note that the structure in which the antenna element 2 is electrically connected to the substrate 3 is not limited to the preferred embodiment shown in FIG. 6B and another connecting structure may be used. In addition, in the example shown in FIG. 6A, the dielectric base 6 of the antenna element 2 has a shape having a front surface wall portion 6*f*, a top surface wall portion 6*t*, a right end surface wall portion 6*r*, and a left end surface wall portion 61. However, the dielectric base 6 may have another shape, such as a rectangular parallelepiped shape, for example. Furthermore, in the example shown in FIG. 6B, the feeding radiation electrode 7 and the non-feeding radiation electrode 18 are provided on the dielectric base 6. However, as in the case of the first to third preferred embodiments, only the feeding radiation electrode 7 may be provided on the dielectric base 6.

The configuration other than the above in the antenna structure 1 of the fifth preferred embodiment is similar to that of the first to fourth preferred embodiments. The dielectric material (not shown in FIGS. 6A and 6B but shown as a dielectric material 8 in FIG. 1A, a high dielectric constant sheet 13 in FIG. 2, and a resin 14 in FIGS. 3A and 4A) having a high dielectric constant is preferably provided in the spaced region between the parallel or substantially parallel open end K and intermediate path 11 of the feeding radiation electrode 7. In addition, when the non-feeding radiation electrode 18 is provided, a dielectric material having a high dielectric constant may be provided in a spaced region between the parallel or substantially parallel open end K and intermediate path (not shown in FIGS. 6A and 6B but shown as an intermediate path 21 in FIG. 5A) of the non-feeding radiation electrode 18.

Hereinafter, a sixth preferred embodiment of the present invention will be described. Note that in the description of the sixth preferred embodiment, like reference numerals denote like components to those of the first to fifth preferred embodiments, and repetitive description of the same components is omitted.

Figure 7A:
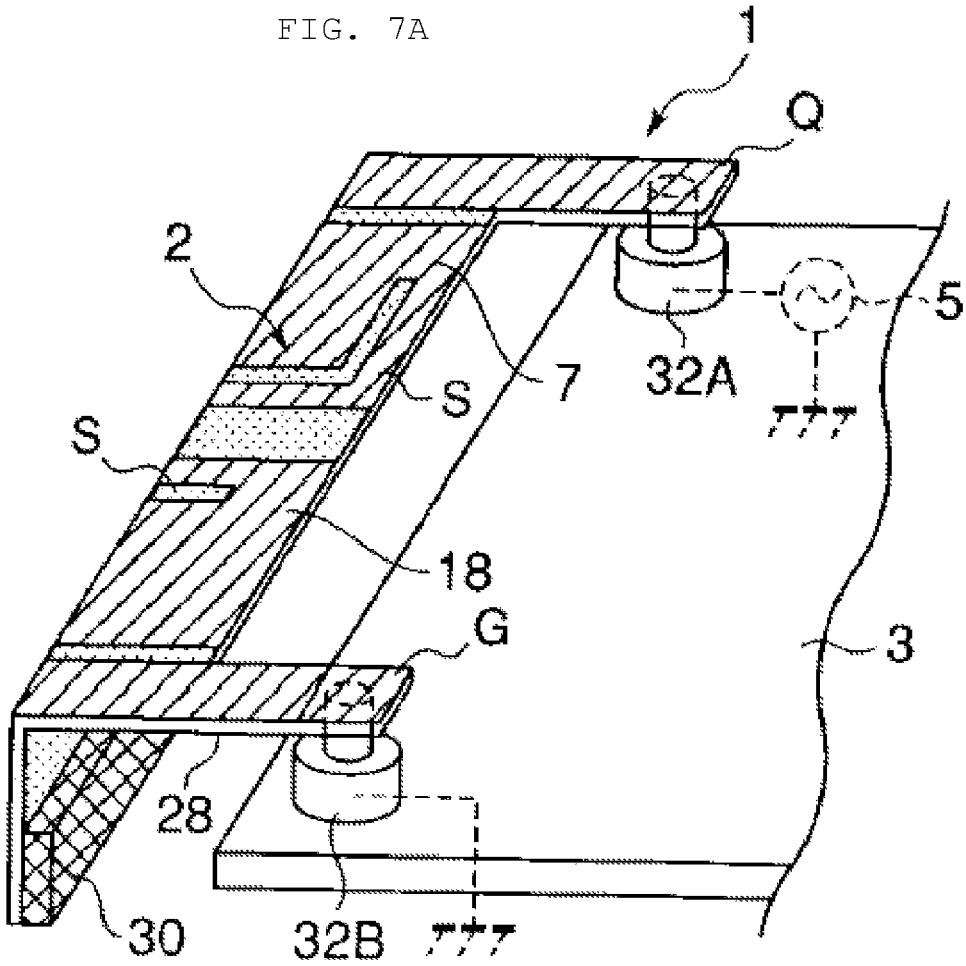
FIG. 7A is a perspective view that illustrates a sixth preferred embodiment of the present invention.

In the sixth preferred embodiment, the antenna element 2 has a dielectric film 28 as shown in FIG. 7A instead of the dielectric base 6. The dielectric film 28 is preferably made of a dielectric material having a low dielectric constant (for example, a relative dielectric constant less than about 6). The feeding radiation electrode 7 and the non-feeding radiation electrode 18, which are defined by conductor films, are arranged on the surface of the dielectric film 28 by, for example, sputtering, vapor deposition, or other suitable method. In addition, a high dielectric constant sheet 30 preferably made of a dielectric material having a dielectric constant greater than the dielectric film 28 (for example, relative dielectric constant greater than or equal to about 6) is provided on the back surface side of the dielectric film 28. The high dielectric constant sheet 30 is provided in the spaced region between the parallel or substantially parallel open end K and intermediate path (not shown in FIGS. 6A and 6B but shown as an intermediate path 11 in FIG. 5A) of the feeding radiation electrode 7 and, where necessary, in the spaced region between the parallel or substantially parallel open end K and intermediate path 21 of the non-feeding radiation electrode 18. Note that in the example shown in FIG. 7A, the high dielectric constant sheet 30 is preferably provided on the back surface side of the dielectric film 28. However, the high dielectric constant sheet 30 may be arranged on the surface of the feeding radiation electrode 7 or non-feeding radiation electrode 18 provided on the front surface side of the dielectric film 28.

Figure 7B:
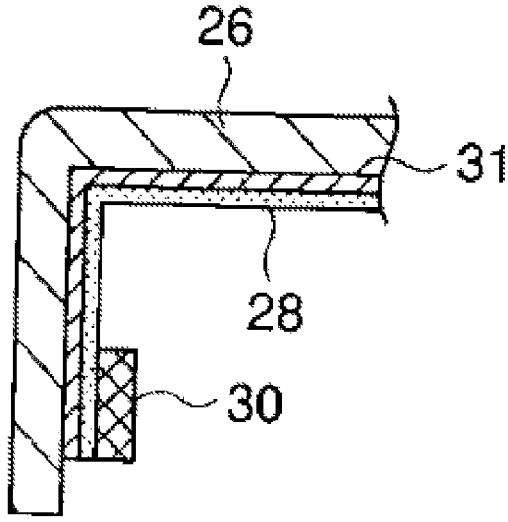
FIG. 7B is a cross-sectional view that illustrates the sixth preferred embodiment of the present invention.

In the sixth preferred embodiment, a resin film, for example, is preferably provided on the surfaces of the feeding radiation electrode 7 and non-feeding radiation electrode 18 to protect the feeding radiation electrode 7 and the non-feeding radiation electrode 18. In addition, as shown in the schematic cross-sectional view of FIG. 7B, the dielectric film 28 is preferably fixedly bonded to the inner wall surface of the housing 26 by an adhesive agent 31, for example. Furthermore, the feeding radiation electrode 7 provided on the dielectric film 28 is preferably electrically connected to the wireless communication circuit 5 of the circuit board 3 through a connecting member 32A shown in FIG. 7A. In addition, the non-feeding radiation electrode 18 provided on the dielectric film 28 is preferably electrically connected to the ground electrode 4 of the circuit board 3 through a connecting member 32B shown in FIG. 7A.

The configuration other than the above in the antenna structure 1 of the sixth preferred embodiment is similar to that of the first to fifth preferred embodiments. Note that in the example shown in FIG. 7A, the non-feeding radiation electrode 18 is preferably provided. However, for example, when the antenna characteristic required by the specifications may be obtained only by the feeding radiation electrode 7, the non-feeding radiation electrode 18 may be omitted. In addition, the dielectric film 28, on which the feeding radiation electrode 7 and the non-feeding radiation electrode 18 are provided, is preferably fixedly supported by the housing 26. However, the dielectric film 28 may be fixedly supported by the substrate 3 by, for example, a support member, or other suitable member. Furthermore, the dielectric film 28 is preferably configured in a shape such that it is bent along the inner wall surface of the housing 26. However, the dielectric film 28 may, for example, have a substantially planar shape that is not bent depending on a location of arrangement.

Hereinafter, a seventh preferred embodiment of the present invention will be described. The seventh preferred embodiment relates to a wireless communication device. The wireless communication device of the seventh preferred embodiment is provided with any one of the antenna structures 1 described in the first to sixth preferred embodiments. In addition, various structures of the wireless communication device, other than the antenna structure, may be used. Here, the configuration of the wireless communication device, other than the antenna structure, may have any configuration, and the description thereof is omitted.

Note that the present invention is not limited to the first to seventh preferred embodiments, and various preferred embodiments may be used. For example, in the first to seventh preferred embodiments, the entire dielectric base 6 or the entire dielectric film 28 is preferably arranged in the non-ground region Zp. However, a portion of the dielectric base 6 or the dielectric film 28 may be arranged in the ground region Zg. In this case, the spaced region between the parallel or substantially parallel open end K and intermediate path 11 of the feeding radiation electrode 7 and the spaced region between the parallel or substantially parallel open end K and intermediate path 21 of the non-feeding radiation electrode 18 are arranged on the side surface of the dielectric base 6 or a portion of the dielectric film 28 in the non-ground region Zp, which is spaced away from the ground region Zg.

In addition, in the example shown in FIGS. 6A and 6B or FIGS. 7A and 7B, the dielectric base 6 or the dielectric film 28 is arranged outside the substrate 3. However, a portion of or the entire the dielectric base 6 or the dielectric film 28 may be arranged on the surface of the substrate 3.

Furthermore, in the first to seventh preferred embodiments, the feeding portion Q of the feeding radiation electrode 7 is set at the lower portion of the side surface (rear surface) 6*b*, adjacent to the ground region Zg, of the dielectric base 6. In addition, the feeding portion side path 10 of the feeding radiation electrode 7 is arranged to extend in a path from the feeding portion Q through the top surface 6*t* of the dielectric base 6 toward the side surface 8 (front surface) 6*f* in the non-ground region Zp away from the ground region Zg. However, the position of the feeding portion Q is not limited to the rear surface 6*b* of the dielectric base 6; and instead, for example, the position of the feeding portion Q may be the bottom surface of the dielectric base 6.

In addition, in the first to seventh preferred embodiments, the feeding portion side path 10 extends from the feeding portion Q through the top surface 6*t* of the dielectric base 6 toward the intermediate path 11 on the front surface 6*f* away from the ground region Zg. The extending path of the feeding portion side path 10 is not limited; and instead, for example, the feeding portion side path 10 may be arranged to extend from the feeding portion Q through the bottom surface of the dielectric base 6 toward the intermediate path 11 formed on the front surface 6*f*. Furthermore, when the feeding portion Q is provided at the lower side of the front surface 6*f* of the dielectric base 6, the feeding portion side path 10 may be omitted. In addition, the feeding portion side path 10 may be extremely short.

Figure 8A:
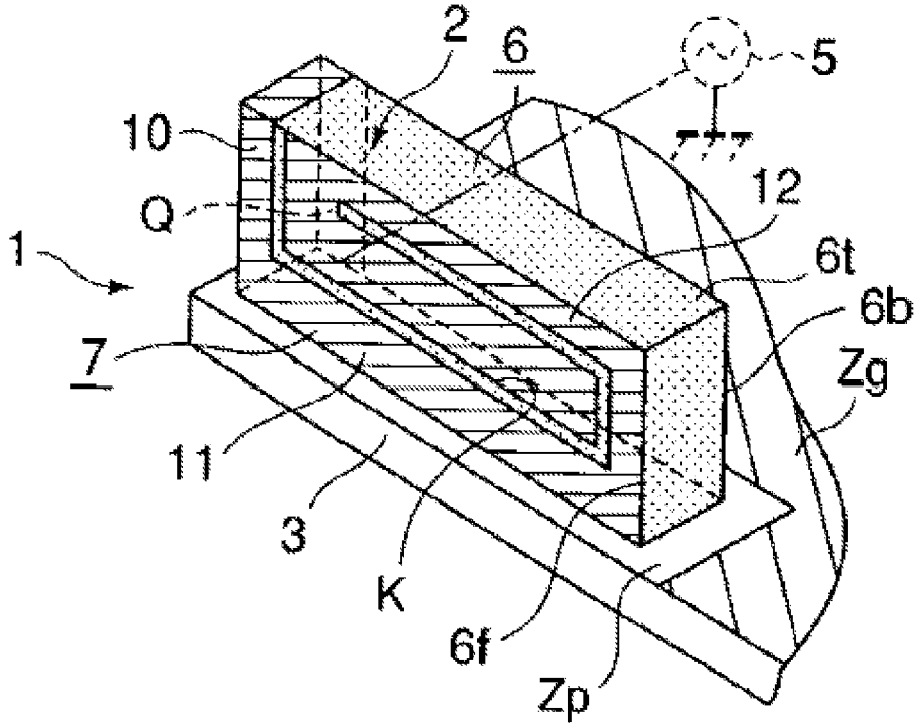
FIG. 8A is a view that illustrates another preferred embodiment of the present invention.

Furthermore, in the first to fifth preferred embodiments, the open end side path 12 of the feeding radiation electrode 7 extends over two surfaces, that is, the front surface 6*f* and top surface 6*t*, of the dielectric base 6. Instead, the open end side path 12 may be, for example, provided only on the front surface 6*f* of the dielectric base 6 as shown in FIG. 8A or may extend over three or more surfaces from among the front surface 6*f*, top surface 6*t*, rear surface 6*b*, and right end surface of the dielectric base 6, including the front surface 6*f*. In this case, the open end side path 12 is arranged to extend along a loop path that extends from the termination of the intermediate path 11 in a direction to separate from the intermediate path 11 on the surface of the dielectric base 6 and then returns toward the intermediate path 11, and the open end K of the extended distal end is arranged parallel or substantially parallel to and spaced apart from the intermediate path 11. Note that the same applies to the non-feeding radiation electrode 18.

Figure 8B:
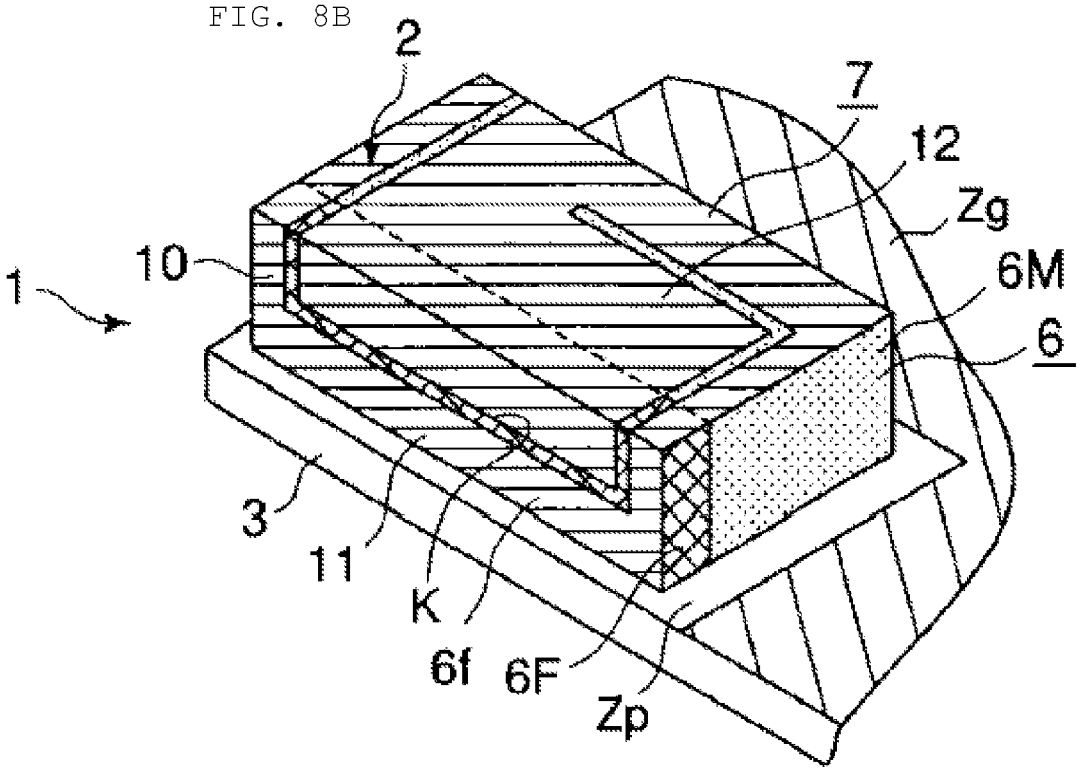
FIG. 8B is a view that illustrates further another preferred embodiment of the present invention.
Figure 9:
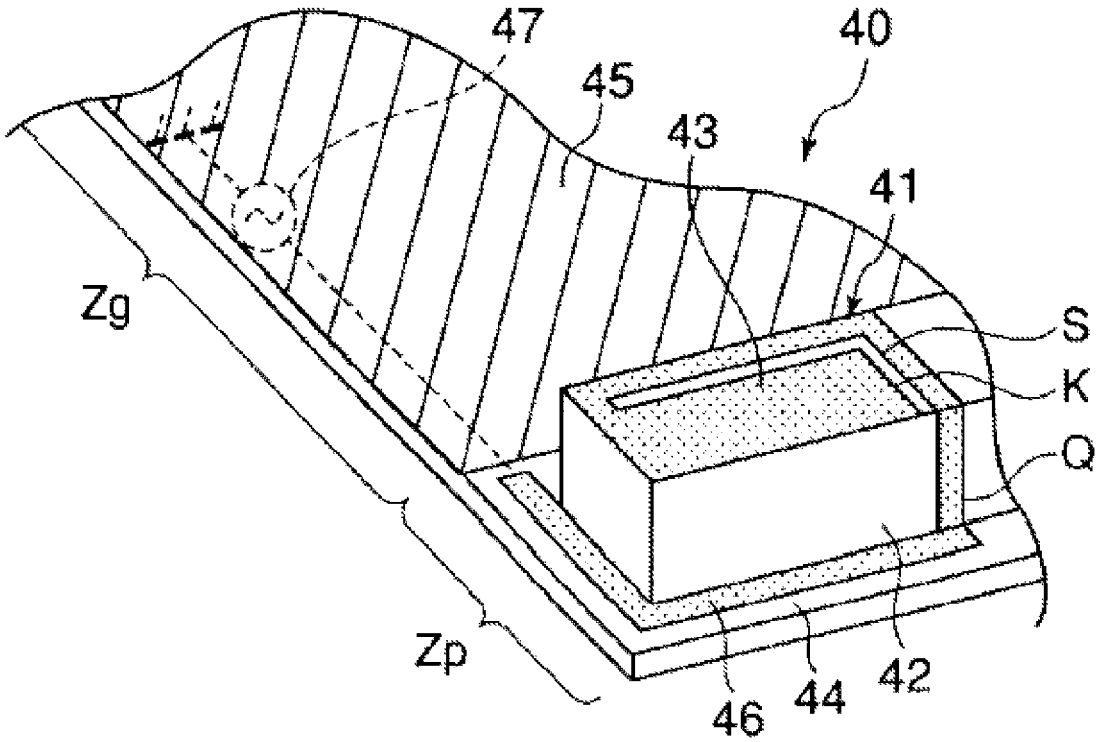
FIG. 9 PRIOR ART
FIG. 9 is a view that illustrates an example of an existing antenna structure.

Furthermore, the dielectric base 6 is not limited to the configurations described in the first to fifth preferred embodiments. For example, as shown in FIG. 8B, the dielectric base 6 may include a base portion 6F, which defines the front surface 6*f* and is made of a dielectric material having a high dielectric constant (for example, relative dielectric constant greater than or equal to about 6), and a base portion 6M, which defines the dielectric base portion other than the base portion 6F and is made of a dielectric material having a low dielectric constant (for example, relative dielectric constant less than about 6).

Furthermore, in the fourth preferred embodiment, the dielectric material 24 for adjusting the electromagnetic coupling state between the feeding radiation electrode 7 and the non-feeding radiation electrode 18 is provided in the spaced region D between the feeding radiation electrode 7 and the non-feeding radiation electrode 18. However, in some cases, such a dielectric material 24 for adjusting the electromagnetic coupling state need not be provided. This is the case in which the electromagnetic coupling state between the feeding radiation electrode 7 and the non-feeding radiation electrode 18 is set in a predetermined state.

The antenna structure according to preferred embodiments of the present invention and the wireless communication device including the same are capable of elongating the electrical length of the feeding radiation electrode with a simple configuration and easily achieving miniaturization. In addition, preferred embodiments of the present invention are capable of improving the reliability in a wide frequency band and in a wireless communication. Thus, the antenna structure according to preferred embodiments of the present invention and the wireless communication device having the same is effectively applied to a wireless communication device that must, for example, be miniaturized and used to communicate in a wide frequency band, such as a cellular phone.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An antenna structure comprising:

an antenna element including a dielectric base and a feeding radiation electrode defining an antenna; and a substrate including a ground region in which a ground electrode is provided and a non-ground region in which no ground electrode is provided; wherein the antenna element is supported by the substrate so that at least a portion of the antenna element is arranged in the non-ground region;

the feeding radiation electrode includes an intermediate path that is connected to a feeding portion of the feeding radiation electrode for electrical conduction and that is arranged to extend in a perimeter direction on a side surface of the dielectric base adjacent to the non-ground region, and an open end side path that is arranged to extend along a loop path that extends from a termination of the intermediate path in a direction so as to separate from the intermediate path on a surface of the dielectric base and then return toward the intermediate path;

an end of the open end side path is parallel or substantially parallel to and spaced apart from the intermediate path;

the dielectric base includes a plurality of base portions including a base portion that includes a portion provided in a spaced region disposed between the parallel or substantially parallel open end and the intermediate path of the feeding radiation electrode; and the base portion that includes the portion provided in the spaced region disposed between the parallel or substantially parallel open end and the intermediate path is made of a dielectric material having a dielectric constant greater than dielectric constants of remaining portions of the plurality of base portions.

2. The antenna structure according to claim 1, wherein the dielectric base portion that includes the portion provided in the spaced region disposed between the parallel or substantially parallel open end and the intermediate path of the feeding radiation electrode is made of a resin that is mixed with a material to increase a dielectric constant.

3. The antenna structure according to claim 1, wherein the feeding radiation electrode is plated on the dielectric base;

the dielectric base includes a base portion made of a resin having a relatively low dielectric constant and a relatively good plating adhesion and a base portion made of a resin having a relatively high dielectric constant and a relatively poor plating adhesion;

the base portion made of the resin having the relatively low dielectric constant and the relatively good plating adhesion defines a dielectric base portion on which the feeding radiation electrode is provided; and the base portion made of the resin having the relatively high dielectric constant and relatively poor plating adhesion defines the spaced region between the parallel or substantially parallel open end and the intermediate path of the feeding radiation electrode.

4. The antenna structure according to claim 1, wherein the feeding radiation electrode is plated on the dielectric base;

the dielectric base includes a first base portion made of a resin having a first relatively low dielectric constant and a first relatively good plating adhesion, a second base portion made of a resin having a relatively high dielectric constant and a relatively poor plating adhesion, and a third base portion made of a resin having a second relatively low dielectric constant and a second relatively poor plating adhesion;

the first base portion defines a surface portion of the dielectric base on which the feeding radiation electrode is provided;

the second base portion defines the spaced region between the parallel or substantially parallel open end and the intermediate path of the feeding radiation electrode; and the third base portion defines a remainder of the base.

5. An antenna structure comprising:

an antenna element including a dielectric base and a feeding radiation electrode defining an antenna; and a substrate including a ground region in which a ground electrode is provided and a non-ground region in which no ground electrode is provided; wherein the antenna element is supported by the substrate so that at least portion of the antenna element is arranged in the non-ground region;

the feeding radiation electrode includes an intermediate path that is connected to a feeding portion of the feeding radiation electrode for electrical conduction and that is arranged to extend in a perimeter direction on a side surface of the dielectric base adjacent to the non-ground region, and an open end side path that is arranged to extend along a loop path that extends from a termination of the intermediate path in a direction so as to separate from the intermediate path on a surface of the dielectric base and then return toward the intermediate path;

an end of the open end side path is parallel or substantially parallel to and spaced apart from the intermediate path; and a dielectric material having a dielectric constant greater than the dielectric base is provided in a spaced region disposed between the parallel or substantially parallel open end and the intermediate path of the feeding radiation electrode.

6. The antenna structure according to claim 5, wherein a non-feeding radiation electrode is provided on the dielectric base in addition to the feeding radiation electrode; and the non-feeding radiation electrode is electromagnetically coupled to the feeding radiation electrode arranged adjacent to and spaced apart from the feeding radiation electrode to generate multiple resonations.

7. The antenna structure according to claim 6, wherein a dielectric material having a dielectric constant, by which an electromagnetic coupling state between the feeding radiation electrode and the non-feeding radiation electrode is adjusted to a predetermined electromagnetic coupling state, is provided in a spaced region disposed between the feeding radiation electrode and the non-feeding radiation electrode.

8. The antenna structure according to claim 1, wherein the antenna element is supported on an inner wall surface of a housing, in which the substrate is accommodated and arranged, such that at least a portion of the antenna element overlaps the non-ground region.

9. The antenna structure according to claim 5, wherein the dielectric base is defined by a dielectric film;

the dielectric film is supported by the substrate such that at least a portion of the dielectric film is arranged in the non-ground region; and the intermediate path of the feeding radiation electrode is arranged along an edge of the dielectric film adjacent to the non-ground region and away from the ground region.

10. The antenna structure according to claim 1, wherein the dielectric material provided in the spaced region disposed between the parallel or substantially parallel open end and intermediate path of the feeding radiation electrode is a resin having a relative dielectric constant greater than or equal to about 6.

11. A wireless communication device comprising the antenna structure according to claim 1.

12. A wireless communication device comprising the antenna structure according to claim 5.

* * * * *